US009693595B2

(12) United States Patent
Lebel et al.

(10) Patent No.: US 9,693,595 B2
(45) Date of Patent: Jul. 4, 2017

(54) HELMET EARPIECE

(75) Inventors: Stéphane Lebel, St. Redempteur (CA); Dominic Giroux Bernier, Montreal (CA); Edward R. Hall, Montreal (CA)

(73) Assignee: Revision Military S.a.r.L., Luxembourg (LU)

( * ) Notice: Subject to any disclaimer, the term of this patent is extended or adjusted under 35 U.S.C. 154(b) by 1213 days.

(21) Appl. No.: 13/359,800

(22) Filed: Jan. 27, 2012

(65) Prior Publication Data

US 2013/0191974 A1 Aug. 1, 2013

(51) Int. Cl.

| | |
|---|---|
| ***A42B 1/08*** | (2006.01) |
| ***A42B 3/16*** | (2006.01) |
| ***A42B 3/32*** | (2006.01) |
| ***F41H 1/08*** | (2006.01) |

(52) U.S. Cl.

CPC ..... *A42B 3/16* (2013.01); *A42B 3/32* (2013.01); *F41H 1/08* (2013.01)

(58) Field of Classification Search

CPC ..... A42B 3/0406; A42B 3/16

See application file for complete search history.

(56) References Cited

U.S. PATENT DOCUMENTS

| | | | | |
|---|---|---|---|---|
| 2,889,555 | A * | 6/1959 | Stuart et al. | 2/6.6 |
| 3,602,329 | A * | 8/1971 | Bauer et al. | 181/129 |
| 5,090,061 | A * | 2/1992 | Kamata | 2/423 |
| 5,093,936 | A * | 3/1992 | Copeland et al. | 2/419 |
| 5,283,914 | A * | 2/1994 | James | 2/424 |
| 7,908,667 | B2 * | 3/2011 | Rogers et al. | 2/6.2 |
| 8,028,344 | B2 * | 10/2011 | Rogers et al. | 2/6.2 |
| 2006/0212998 | A1 * | 9/2006 | Gath | 2/423 |
| 2008/0092278 | A1 * | 4/2008 | Rogers et al. | 2/422 |
| 2009/0044316 | A1 * | 2/2009 | Udelhofen | 2/424 |
| 2012/0079646 | A1 * | 4/2012 | Belanger et al. | 2/425 |
| 2013/0219598 | A1 * | 8/2013 | Pfanner et al. | 2/423 |
| 2014/0033406 | A1 * | 2/2014 | Lebel et al. | 2/422 |

FOREIGN PATENT DOCUMENTS

| | | |
|---|---|---|
| EP | 0 474 937 A1 | 3/1992 |
| JP | 2004-068201 A | 3/2004 |

OTHER PUBLICATIONS

International Search Report and Written Opinion for PCT/IB2013/000609, mailed Aug. 7, 2013.

OPS-Core Ballistic Helmet & Accessories Information, printed Jan. 10, 2012, 10 pgs, obtained from www.ops-core.com.

* cited by examiner

*Primary Examiner* — Sally Haden

(74) *Attorney, Agent, or Firm* — Wolf, Greenfield & Sacks, P.C.

(57) ABSTRACT

A helmet earpiece is provided which includes a body, a first feature configured to fit with a complimentary first feature associated with a helmet, and a second feature configured to fit with a complimentary second feature associated with the helmet. The first and second features on the body may be configured to fit with the respective complimentary first and second features associated with the helmet to mount the helmet earpiece to the helmet. The first feature may include an opening, and a lock adjacent the opening. The lock has an unlocked position and a locked position, where in the unlocked position, the opening may be configured to receive the complimentary first feature associated with the helmet, and in the locked position, the lock may be configured to retain the complimentary first feature in the opening.

13 Claims, 13 Drawing Sheets

HELMET EARPIECE

FIELD

The present invention is directed to a helmet and a detachable helmet earpiece.

BACKGROUND

Helmets are used in numerous applications, including various military and sporting applications. In certain situations, it may be desirable for the helmet to cover the ears of the wearer. In other situations, it may be desirable for the ears to be exposed. For example, hearing may be enhanced when the helmet does not conceal the wearer's ears. A helmet that exposes the wearer's ears may be more lightweight and cooler in comparison to a helmet that shields the ears of the wearer.

Detachable earpieces for helmets exist, but many require tools to attach and/or detach the earpieces to the helmet. Many are difficult and/or time consuming to attach and/or detach.

SUMMARY

According to one aspect, a helmet earpiece is provided. The helmet earpiece includes a body configured to cover at least a portion of an ear, a first feature on the body configured to fit with a complimentary first feature associated with a helmet, and a second feature on the body configured to fit with a complimentary second feature associated with the helmet. The first and second features on the body are configured to fit with the respective complimentary first and second features associated with the helmet to detachably mount the helmet earpiece to the helmet without the use of a tool. The first feature on the body includes an opening in the body, and a lock adjacent the opening. The lock has an unlocked position and a locked position, where in the unlocked position, the opening is configured to receive the complimentary first feature associated with the helmet, and in the locked position, the lock is configured to retain the complimentary first feature in the opening.

According to another aspect, a helmet earpiece is provided. The helmet earpiece includes a body configured to cover at least a portion of an ear, a first feature on the body configured to fit with a complimentary first feature associated with a helmet, and a second feature on the body configured to fit with a complimentary second feature associated with the helmet. The first and second features on the body are configured to fit with the respective complimentary first and second features associated with the helmet to detachably mount the helmet earpiece to the helmet without the use of a tool. The first feature on the body includes a slot in the body, where the slot includes a first portion sized to receive the complimentary first feature associated with the helmet, and a second portion sized to retain the complimentary first feature, where a width of the first portion is larger than a width of the second portion.

According to yet another embodiment, a method of attaching a helmet earpiece to a helmet is provided. The method includes mounting a helmet earpiece to a helmet such that a first feature associated with the helmet fits into an opening in an earpiece body, repositioning the first feature associated with the helmet from a first portion within the opening into a second portion within the opening, and moving a lock on the earpiece body from an unlocked position into a locked position, where in the locked position, the lock is configured to retain the first feature associated with the helmet in the second portion of the opening.

Various embodiments of the present invention provide certain advantages. Not all embodiments of the invention share the same advantages and those that do may not share them under all circumstances.

Further features and advantages of the present invention, as well as the structure of various embodiments that incorporate aspects of the invention are described in detail below with reference to the accompanying drawings.

BRIEF DESCRIPTION OF DRAWINGS

The foregoing and other objects and advantages of the invention will be appreciated more fully from the following drawings, wherein like reference characters designate like features, in which.

DETAILED DESCRIPTION

The inventors recognized a need for a detachable helmet earpiece that is configured to more easily attach to and/or detach from a helmet. In one embodiment, the connection or removal of the helmet earpiece is tool-free.

Aspects are directed to a helmet earpiece that can be attached to and/or detached from the helmet while the wearer is wearing the helmet. For example, it is contemplated that in a military application, a wearer could routinely attach and/detach the earpiece, as needed, when the wearer is deployed in the field. In this respect, the safety of the wearer is not compromised because the helmet does not need to be removed. Furthermore, the earpiece may be configured such that a wearer can mount and/or dismount the earpiece to the helmet with only one hand.

As set forth below, aspects are directed to a helmet earpiece which includes a first feature configured to fit with a complimentary first feature associated with a helmet. The first feature on the helmet earpiece may include an opening which may receive the complimentary feature on the helmet. The opening may engage a projection on the helmet that exists on many conventional helmets. For example, as set forth below, in one embodiment, the earpiece opening is configured to engage with a bolt located on the helmet. The earpiece may further include a lock having an unlocked position and a locked position, where in the locked position, the lock retains the complimentary helmet feature in the opening.

Aspects are directed to a helmet earpiece which also includes a second feature which is configured to fit a complimentary second feature associated with the helmet. The second feature may be spaced apart from the first feature on the earpiece. The second feature of the helmet earpiece may be similar to or substantially identical to the first feature on the helmet earpiece. For example, the earpiece may include a second opening configured to receive a second projection on the helmet. As set forth below, it is also contemplated that the second feature on the helmet earpiece may also have a configuration that is different from the first feature.

Figure 1:
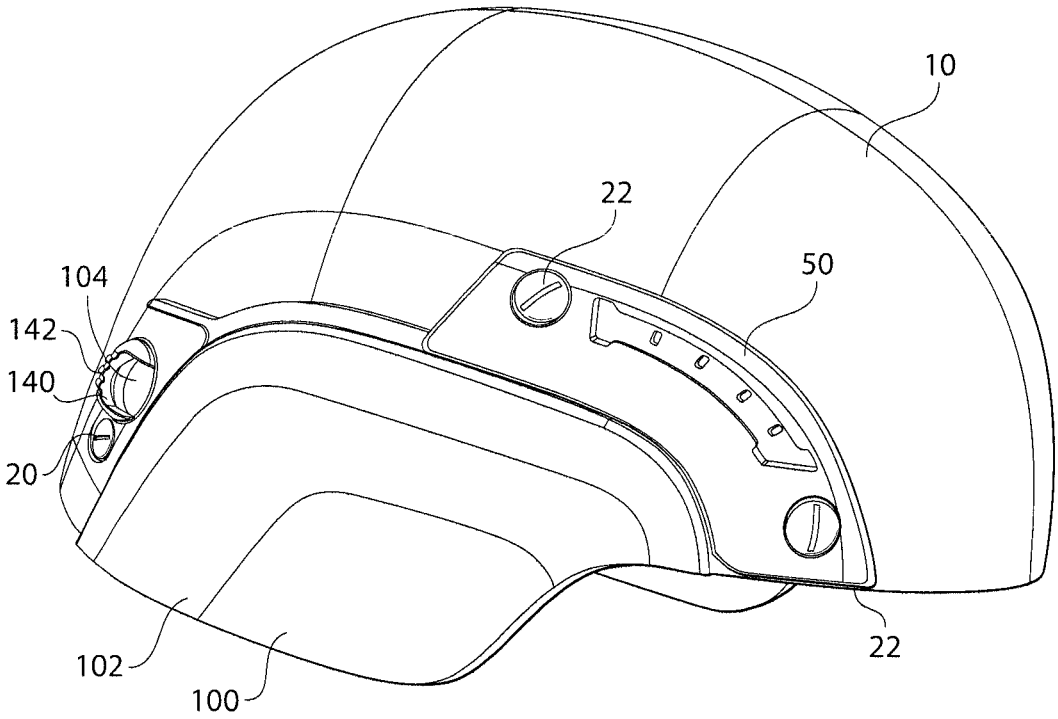
FIG. 1 is a front side perspective view of one embodiment of a helmet earpiece attached to a helmet.
Figure 2:
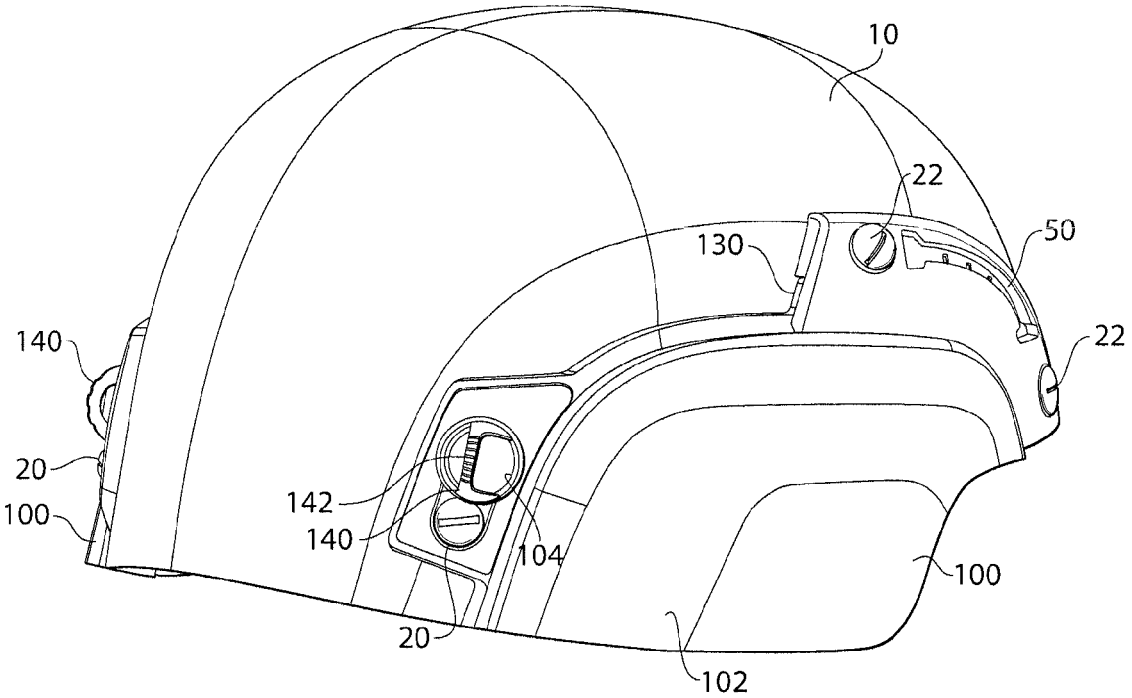
FIG. 2 is a rear side perspective view of the embodiment shown in FIG. 1.

Turning now to the FIGS. 1-10, one embodiment of a helmet 10 and helmet earpiece 100 are illustrated. FIGS. 1-2 illustrate the earpiece 100 attached to the helmet 10, and as discussed in greater detail below, in FIGS. 1-2, the earpiece 100 is shown in a locked position which prevents the earpiece 100 from being detached from the helmet 10.

The earpiece 100 has a body 102 with at least one opening 104 that is configured to fit with a complimentary first feature associated with the helmet 10. In one illustrative embodiment, the opening 104 engages with a projection 20 on the helmet 10. As set forth in greater detail below, the earpiece 100 may include a lock 140 adjacent the opening 104. The lock 140 has an unlocked position in which the opening 104 may receive the helmet projection 20, and a locked position in which the lock 140 may retain the helmet projection 20 in the opening 104.

FIGS. 1-2 illustrate one embodiment of the helmet earpiece 100 mounted to the helmet 10 where the lock 140 is in the locked position. In contrast, in FIGS. 9-10, the lock 140 is shown in an unlocked position. In one illustrative embodiment, the lock 140 is rotatable between the unlocked and locked positions. As illustrated, the lock 140 may rotate at least approximately 90° between the unlocked position and the locked position. In another embodiment, the lock may rotate at least approximately 180° between the unlocked position and the locked position. In yet another embodiment, the lock 140 may rotate at least approximately 45° between the unlocked and locked positions. It is also contemplated that the lock 140 may linearly slide to move between the unlocked and locked positions, as the invention is not necessarily so limited. Furthermore, it is also contemplated that the lock may slide and rotate to move between the unlocked and locked positions.

The earpiece 100 may be mounted to the helmet 10 by moving the earpiece 100 to the helmet 10 and aligning the opening 104 in the earpiece 100 with the helmet projection 20 such that the helmet projection 20 extends into the opening 104. The lock 140 is moved from the unlocked position into the locked position to prevent the helmet projection 20 from separating from the opening 104. The lock 140 may include an outwardly extending grip 142 which may be grasped to move of the lock. As shown, the grip 142 may include a fluted edge for the wearer to grasp.

Figure 5:
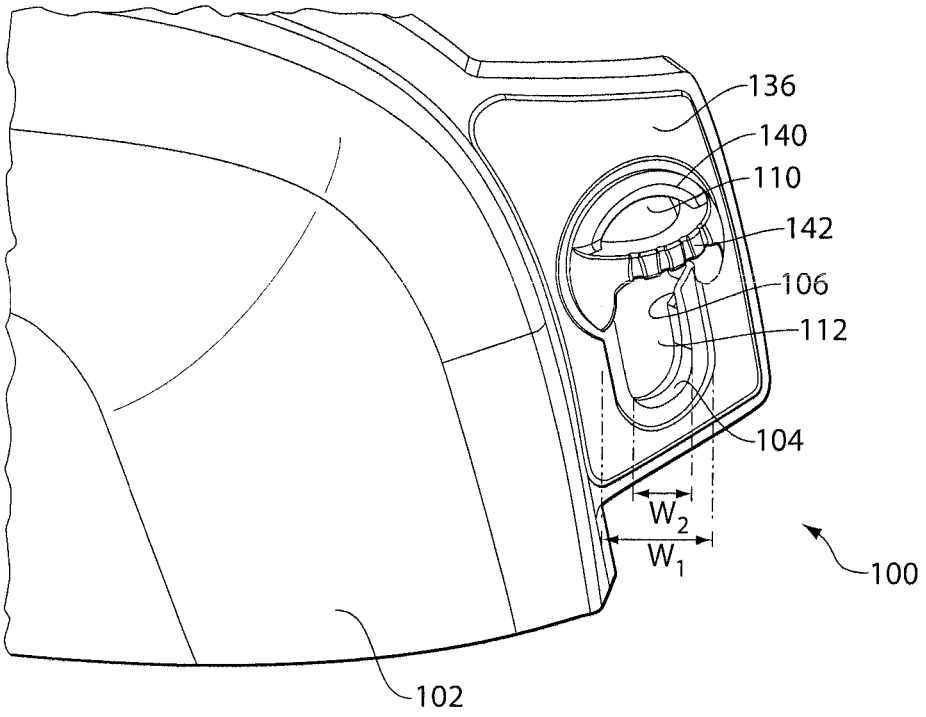
FIG. 5 is a detailed perspective view of the lock on the helmet earpiece shown in FIG. 3.
Figure 6:
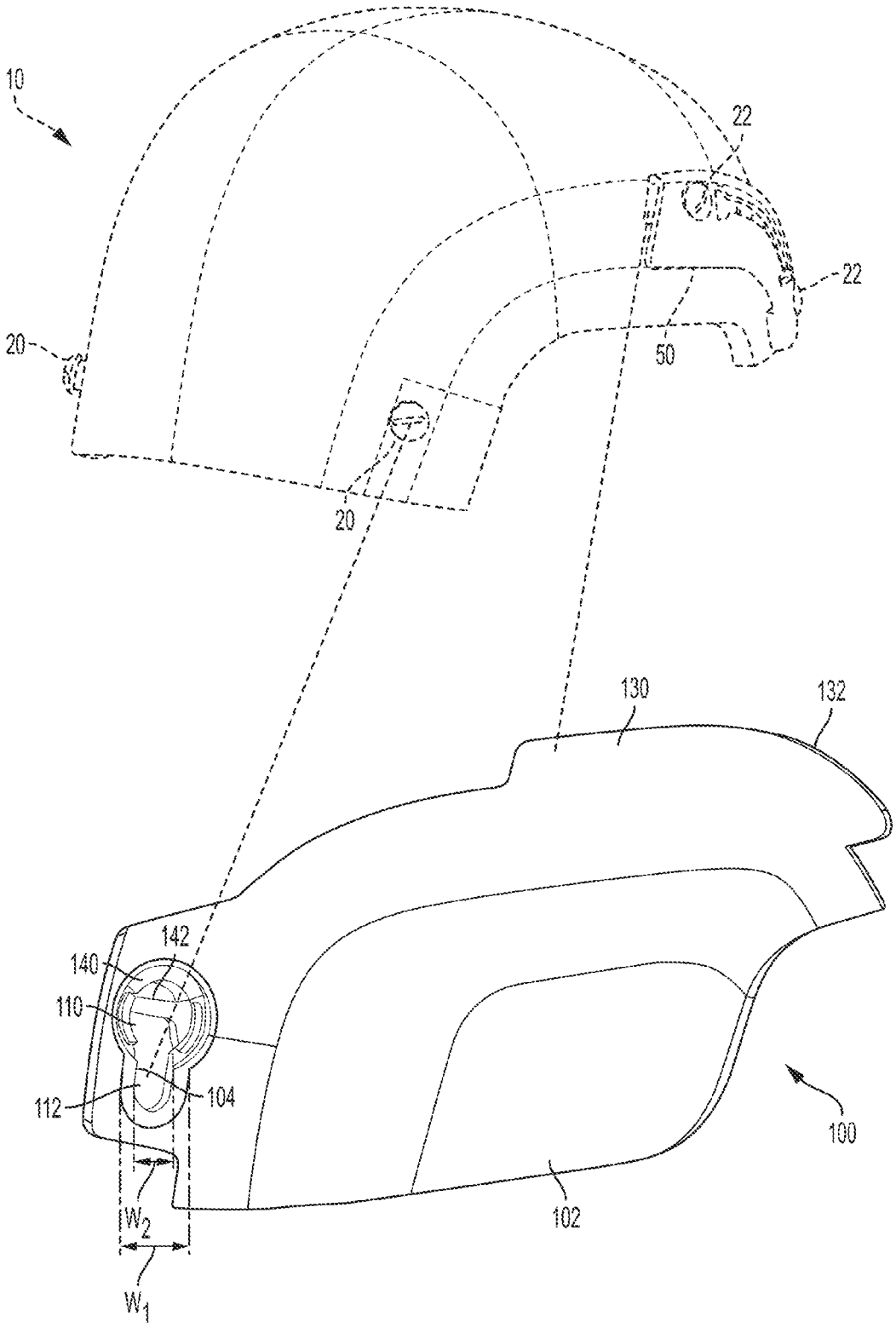
FIG. 6 is a rear perspective view of the helmet earpiece shown in FIG. 3.
Figure 7:
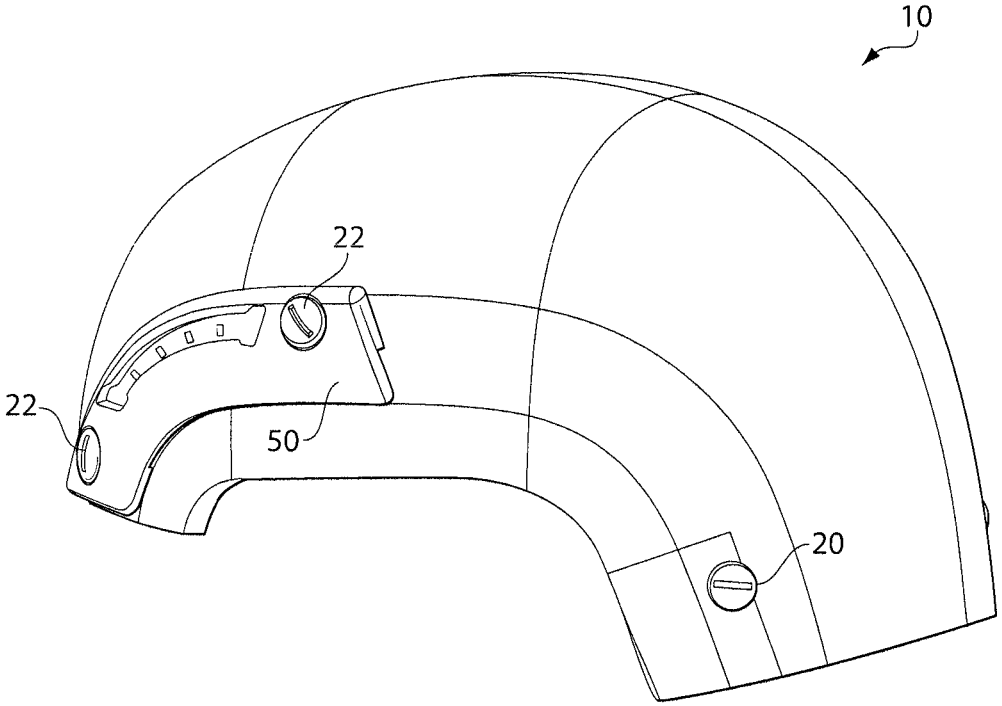
FIG. 7 is a rear side perspective view of one embodiment of a helmet.
Figure 8:
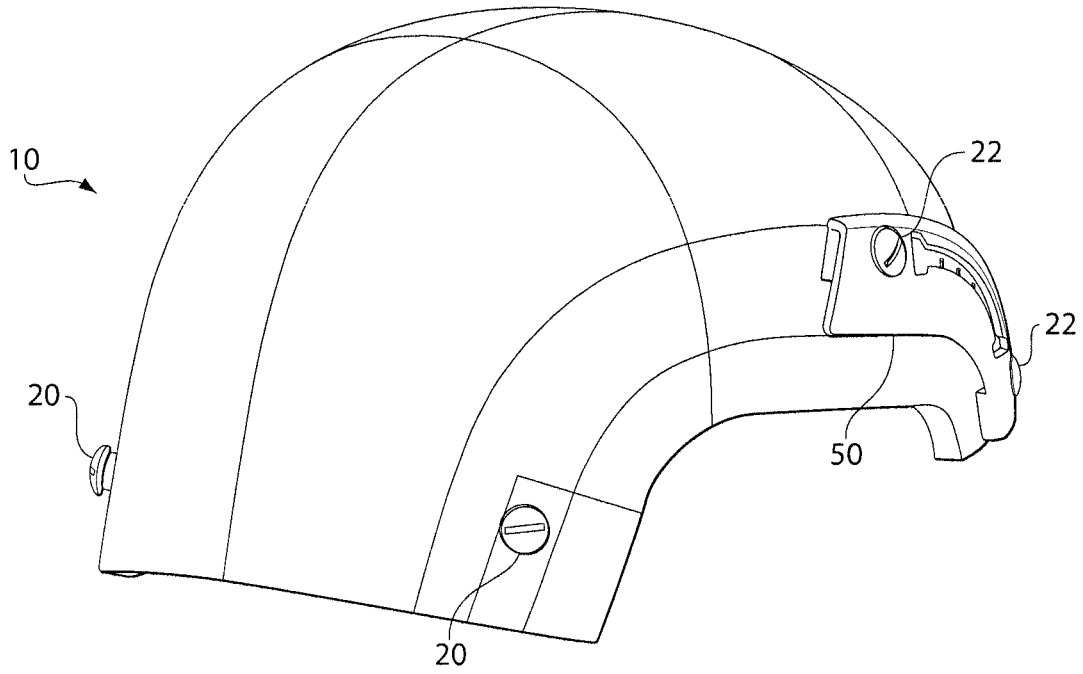
FIG. 8 is another rear side perspective view of the helmet shown in FIG. 7.
Figure 9:
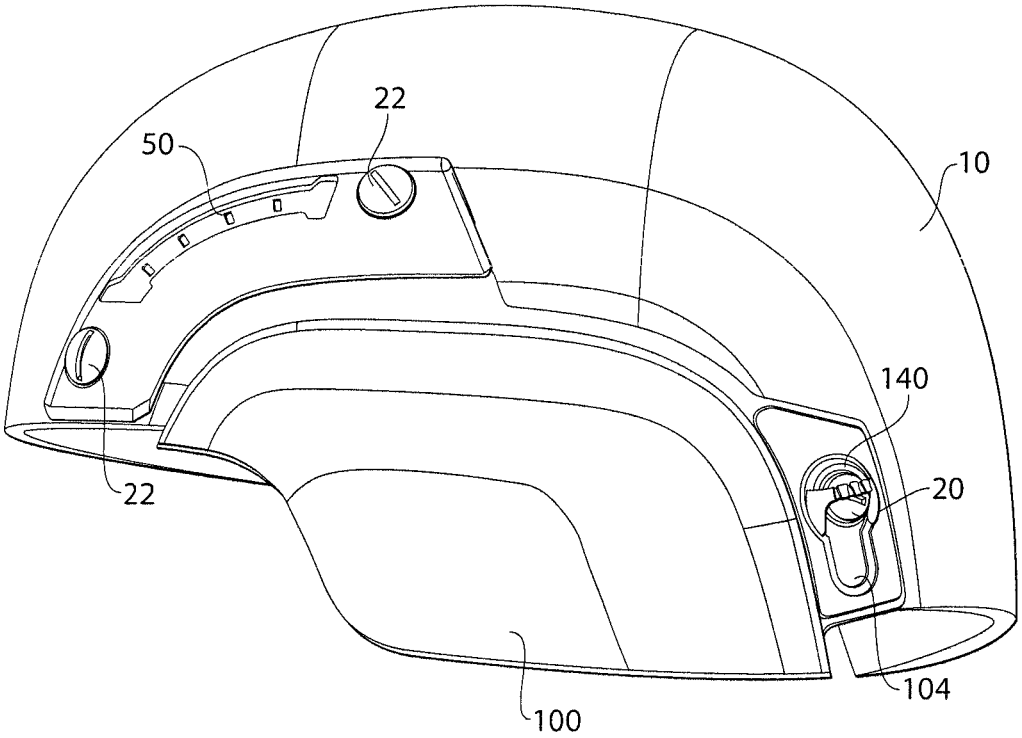
FIG. 9 is a perspective view of one embodiment of a helmet earpiece and helmet with the earpiece lock in an unlocked position.
Figure 10:
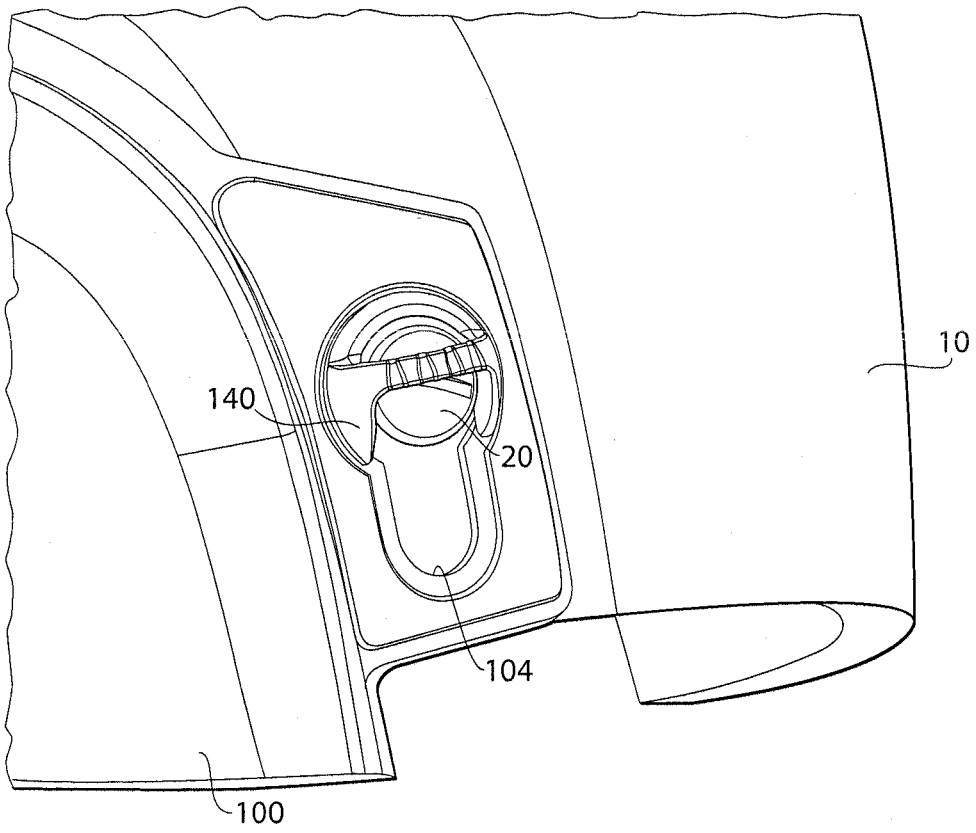
FIG. 10 is a detailed perspective view of the earpiece lock in the unlocked position shown in FIG. 9.

As shown in the embodiment illustrated in FIGS. 5-6, the opening 104 may be configured as a slot which includes a first portion 110 sized to receive the helmet projection 20 when the lock is in the unlocked position. The slot may also include a second portion 112 sized to retain the helmet projection 20 when the lock 140 is in the locked position. As illustrated, the first portion 110 of the slot may be located at one end of the opening 104 and the second portion 112 of the slot may be located at the opposite end of the opening 104. As shown in FIGS. 5-6, the first portion 110 may have a width $W_1$ and the second portion 112 may have a second width $W_2$, where the width $W_1$ of the first portion 110 may be larger than the $W_2$ of the second portion 112.

The width $W_1$ of the first portion 110 of the slot may be greater than a corresponding width of the helmet projection 20 such the helmet projection 20 fits into the slot. The width $W_2$ of the second portion 112 of the slot may be less than a corresponding width of the helmet projection 20. For example, in one illustrative embodiment, the helmet projection 20 is a bolt and the width of the bolt head is less than the width $W_1$ of the first portion 110 but greater than the width $W_2$ of the second portion 112. In this respect, the helmet projection 20 may not be able to slide out of second portion 112 of the slot. In one embodiment, the width $W_1$ of the first portion 110 is between approximately 10-30 millimeters. In one embodiment, the width $W_1$ is approximately 15 millimeters. In one embodiment, the width $W_2$ of the second portion 112 is between approximately 5-20 millimeters. In one embodiment, the width $W_2$ is approximately 10 millimeters.

As also shown in the embodiment illustrated in FIGS. 5-6, the slot may be substantially key-hole shaped, where the first portion 110 of the slot is substantially circular shaped and the second portion 112 of the slot is substantially elliptical shaped. However, the invention is not so limited, as other shapes and configurations for the opening 104 are also contemplated including, but not limited to substantially circular shaped, oval shaped, square shaped, rectangular shaped, triangular shaped, or irregular shaped openings. In one embodiment, the opening 104 extends through the earpiece body 102. In another embodiment, the opening 104 may only extend partially into the earpiece body 102.

The wearer may attach the earpiece 100 to the helmet 10 by using one hand to mount the earpiece 100 to the helmet 10 such that the helmet projection 20 (such as a bolt head) extends into the opening 104 in the earpiece body 104. After the projection is seated in the opening 104, the wearer may use one hand to reposition the projection 20 from the first portion 110 within the opening 104 (see FIGS. 9-10) into the second portion 112 within the opening 104 (see FIGS. 1-2). The wearer may grasp the grip 142 to move the lock 140 on the earpiece body 102 from the unlocked position into the locked position to lock the projection 20 in the opening.

As shown in FIGS. 1-2, when the lock 140 is moved into the locked position, the lock 140 retains the helmet projection 20 in the slot. The lock 140 may prevent the helmet projection 20 from moving out of the second portion of the slot and back into the first portion 110 of the slot. In one illustrative embodiment, a portion of the lock 140 obstructs the slot and prevents movement of the helmet projection 20. A portion of the lock 140 may contact the helmet projection 20 to prevent movement of the helmet projection.

The lock 140 may be configured in a variety of ways, as the invention is not necessarily so limited. In one illustrative embodiment, the lock 140 has a substantially C-shaped body. The arms of the substantially C-shaped body may define an opening, and as shown in FIGS. 5-6, when in the unlocked position, the arms of the substantially C-shaped lock body may be positioned along a perimeter of the opening 104 such that the lock 140 does not interfere with the passage between the first and second portions 110, 112 of the opening 104. When in the locked position, the arms of the substantially C-shaped body may move into the opening 104 and may obstruct the region between first and second portions 110, 112 of the opening 104.

The lock 140 may be coupled to the earpiece body 102 in a variety of ways, as the invention is not necessarily limited in this respect. As shown in the embodiment of FIGS. 5-6, the perimeter of the opening 104 may include a track 106, and the lock 140 may be configured to move along the track 106 between the unlocked position and the locked position. The lock 140 may be snap-fit or press fit into the opening 104. In one embodiment, there is a friction fit between the lock 140 and the track 106 which retains the position of the lock 140. It is also contemplated that the lock 140 may include a spring which biases the lock in the locked position. In one embodiment where the lock 140 is rotatable, the lock 140 may be designed to rotate at least 360° and the lock 140 may be able to rotate freely around the track 106. In such a configuration, the lock 140 may be rotated either in a clockwise direction or a counter-clockwise direction to lock and unlock. In another embodiment, the lock 140 may include a stop (not shown) which may limit the movement of the lock 140.

As mentioned above, the helmet earpiece 100 may include a second feature configured to fit with a complimentary second feature associated with the helmet 10. In one embodiment, the second feature is a flange 130 spaced apart from the opening 104. The flange 130 may fit within a channel 50 on the helmet 10. As set forth below, the channel may be integrally formed with the helmet, or the channel may be formed separately from the helmet. The channel 50 may include internal features (not shown) that engage with the flange 130 to prevent the helmet earpiece 100 from detaching from the helmet 10.

Figure 3:
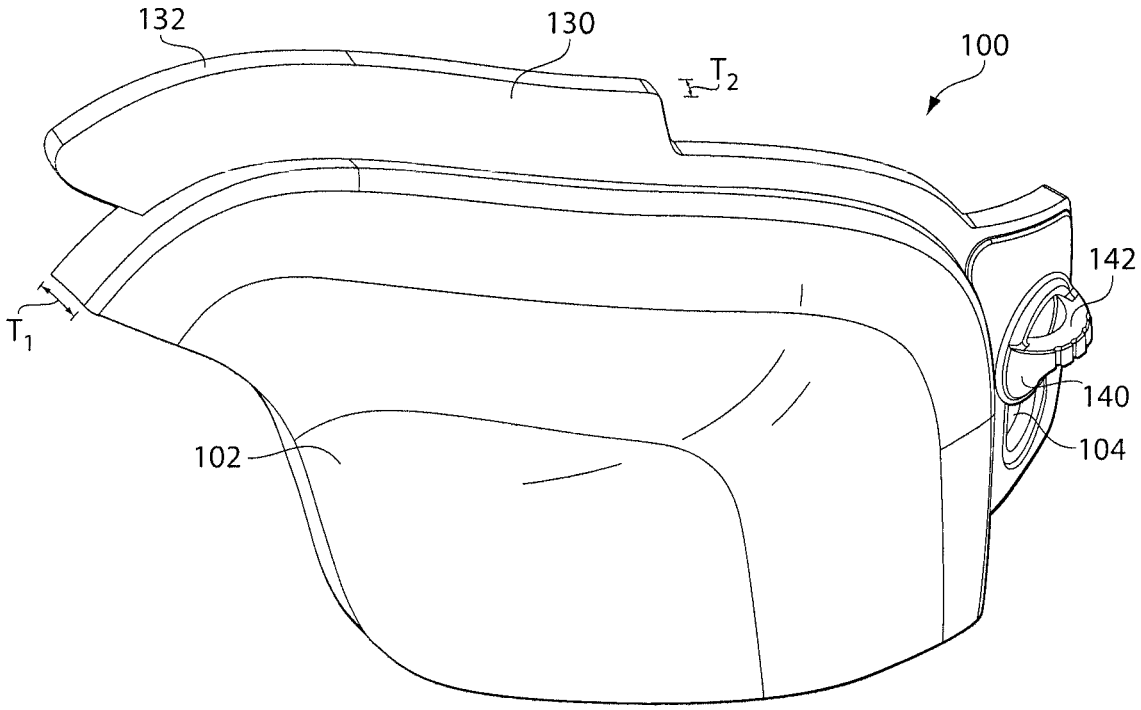
FIG. 3 is a perspective view of a helmet earpiece according to one embodiment.

The flange 130 may overlap with the shell of the helmet. In one embodiment, the flange 130 may overlap at least an approximately 10 mm section of the helmet. In another embodiment, the flange 130 may overlap at least an approximately 20 mm section of the helmet. As shown in FIG. 3, the flange 130 may have a reduced thickness in comparison to the body 102 of the earpiece 100. In particular, the thickness $T_2$ of the flange 130 is less than the thickness $T_1$ of the body 102 of the earpiece 100. In one embodiment, the thickness $T_1$ of the body 104 of the earpiece 100 is between approximately 5-20 millimeters. In one embodiment, the thickness $T_1$ is approximately 9 millimeters. In one embodiment, the thickness $T_2$ of the flange 130 is between approximately 5-15 millimeters. In one embodiment, the thickness $T_2$ is approximately 4 millimeters. It should be appreciated that the thicknesses of the flange 130 and the body 102 may be substantially uniform. Alternatively, the thicknesses of the flange 130 and/or the body 102 may vary across the length of the earpiece 100.

As shown in FIGS. 1-2, the channel 50 may be formed as a separate piece that is coupled to the helmet 10. For example, one or more fasteners 22 may couple the channel 50 to the helmet 10, and/or an adhesive may be used to couple the channel 50 to the helmet 10. It is also contemplated that the channel 50 may be integrally formed with the helmet 10.

In one illustrative embodiment, the channel 50 is substantially U-shaped and the flange 130 is shaped to be inserted into the channel 50 to assist in retaining the helmet earpiece 100 to the helmet 10. The channel may include features (not shown) that engage with the flange 130 to retain the earpiece 100 to the helmet 10. The channel 50 may be curved and the flange 130 may also be configured with a substantially mating curve edge 132. In another embodiment, the channel 50 may be shaped differently, and may for example be L-shaped, as the invention is not necessarily so limited.

The helmet earpiece 100 may be configured in a variety of shapes, as the invention is not necessarily limited in this respect. The earpiece body 102 may cover at least a portion of an ear, and in one embodiment, the earpiece body may be designed to completely cover an ear. The earpiece body 102 may have a rounded upper surface with a shape that substantially follows a mating surface of the helmet 10. The earpiece body 102 may also have a rounded lower surface. In one embodiment, the opening 104 is positioned on one side of the earpiece body 102. As illustrated, the opening 104 may be positioned along a side of the body 102 that is adjacent a rear portion of the helmet when the earpiece is mounted to the helmet. The earpiece body 104 may be curved to substantially follow the contour of a wearer's ear. Other configurations are also contemplated, and for example, the earpiece 100 may be substantially planar.

Figure 4:
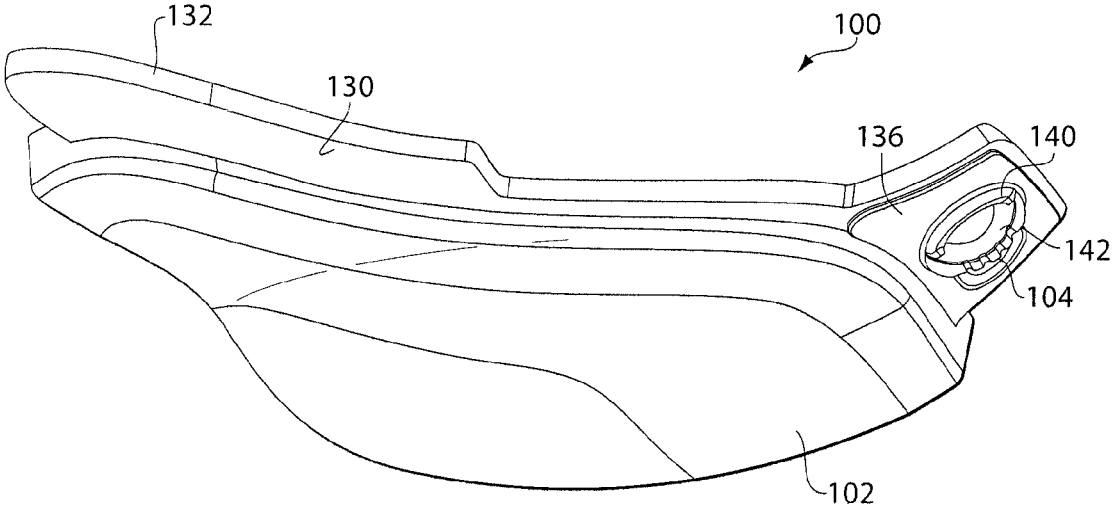
FIG. 4 is a top perspective view of the helmet earpiece shown in FIG. 3.

The earpiece flange 130 may be positioned on a top surface of the earpiece body 102 and the opening 104 is positioned adjacent a side surface of the earpiece body 102. As illustrated in FIG. 4, the opening 102 may be positioned on a flange 136 that is spaced apart from flange 130.

The helmet 10 may be configured in a variety of shapes, as the invention is not necessarily limited in this respect. The helmet 10 may include a crown, a front portion, a rear portion, a left side portion, and a right side portion. A first earpiece may mount to the right side portion of the helmet and a second earpiece may mount to the left side portion.

Figure 11:
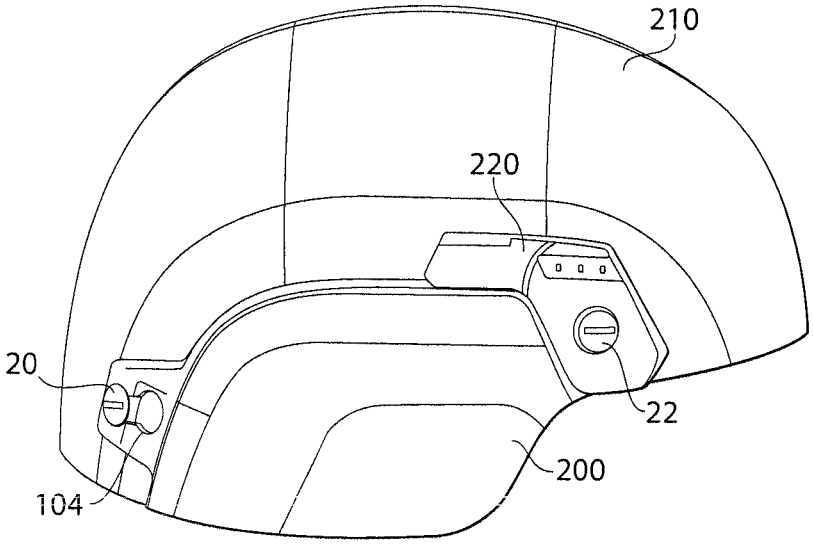
FIGS. 11-12 are side views of a helmet earpiece and helmet according to another embodiment.
Figure 12:
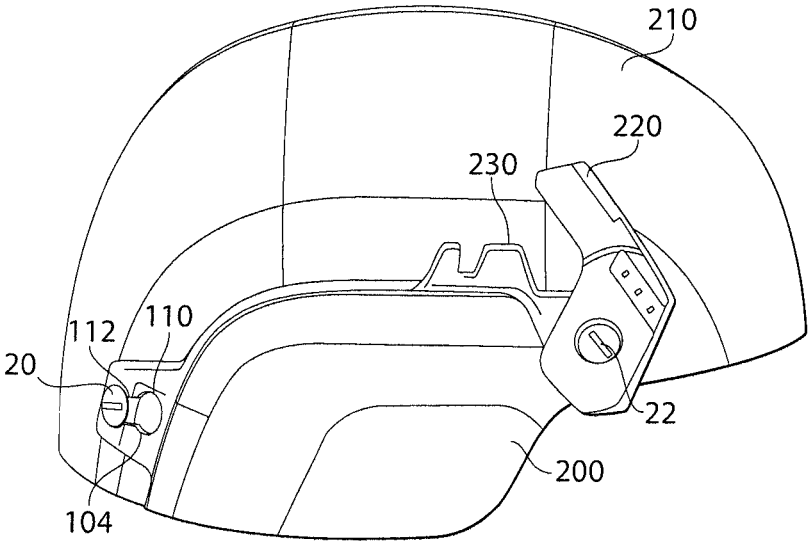

FIGS. 11-12 illustrate another embodiment of a helmet earpiece 200 and helmet 210. In this embodiment, the helmet channel 220 is pivotable between an open position shown in FIG. 12 to a closed position shown in FIG. 11. For example, fastener 22 may pivotally couple the helmet channel 220 to the helmet. As shown in FIG. 12, the earpiece 200 may include an irregular shaped flange 230 that is configured to fit within the channel 220 when the channel 220 is in the closed position. The channel 220 may include internal features (not shown) that engage with the flange 230 to maintain the channel 220 in the closed position. The channel 220 may move into the open position shown in FIG. 11 to insert the helmet projection 20 into the opening 104 in the helmet earpiece 200. The channel 220 may be moved into the closed position shown in FIG. 12 to lock the earpiece 200 to the helmet 210. It is also contemplated that the channel 230 is slideably movable relative the helmet between an open position and a closed position, as the invention is not necessarily so limited.

As illustrated in FIGS. 11-12, the opening 104 in the earpiece 200 may include a first portion 110 sized to receive the helmet projection 20, and a second portion 112 sized to retain the helmet projection 20. As mentioned above, the width of the first portion 110 may be larger than the of the second portion 112. In the particular embodiment illustrated in FIGS. 11-12, the opening 104 extends in a substantially horizontal orientation. In contrast, in the embodiment shown in FIG. 2, the opening 104 is positioned to extend in a substantially vertical orientation. In its closed position, the channel 220 may lock the helmet projection 20 in the second portion 112 of the opening 104, thus preventing the projection 20 from moving out of the opening 104.

Figure 13:
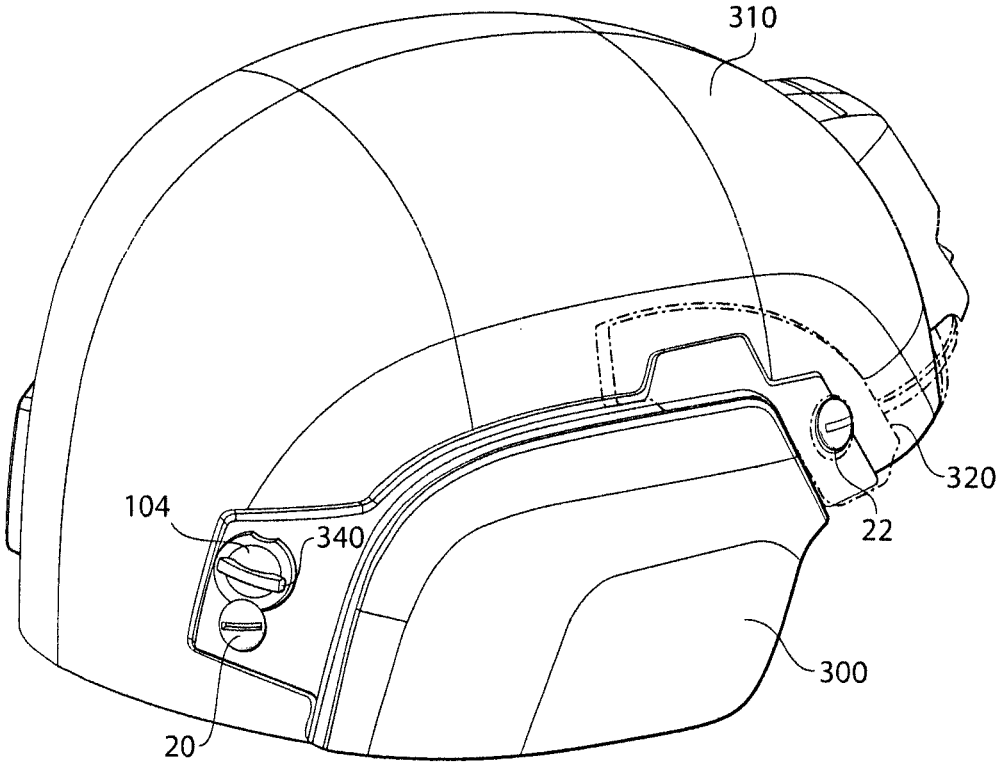
FIGS. 13-14 are perspective views of a helmet earpiece and helmet according to yet another embodiment.
Figure 14:
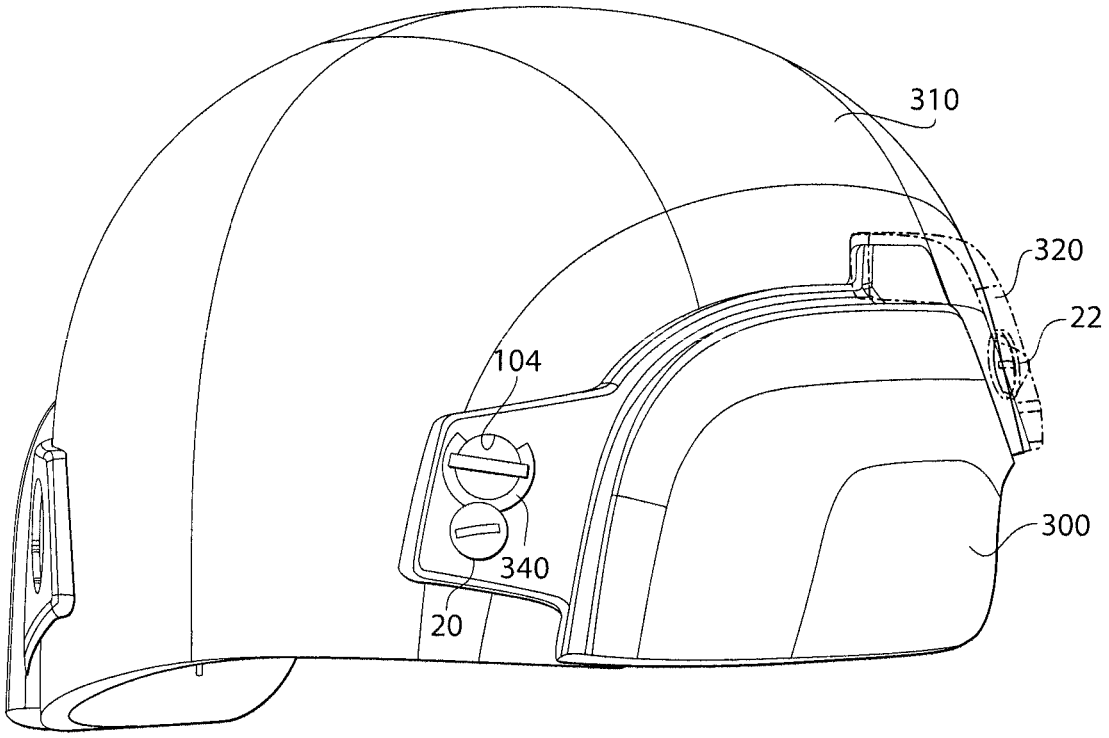

FIGS. 13-14 illustrate another embodiment of a helmet earpiece 300 and helmet 310. In this embodiment, the helmet channel 320 is pivotable between an open position and a closed position. For example, the fastener 22 may pivotally couple the channel 320 to the helmet 210. The channel 320 may be moved into an open position (not shown) to insert the helmet projection 20 into the opening 104 in the helmet earpiece 300. The channel 320 may be moved into the closed position shown in FIGS. 13-14 to lock the earpiece 300 to the helmet 310. In this particular embodiment, the earpiece 300 also includes a lock 340, which is configured similar to the above-described lock 140. The lock 340 has an unlocked position (shown in FIG. 13) in which the opening 104 may receive at least a portion of the helmet projection 20, and a locked position (shown in FIG. 14) in which the lock 340 may retain the helmet projection 20 in the opening 104.

It is contemplated that there is both a left earpiece and a right earpiece. In one embodiment, the left and right earpieces are a mirror image of each other. It should be recognized that in such embodiments, the helmet 10 may also include a channel 50 and at least one projection 20 on both the left and right sides of the helmet 10.

As mentioned above, aspects of the invention are directed to a helmet earpiece that has an opening 104 that engages with a portion of the helmet. For example, in one embodiment, the earpiece opening 104 engages with a bolt located on the helmet. Many conventional military helmets have at least one bolt (and often two bolts) positioned on each side of the helmet. These bolts are typically used to secure a chin strap to the helmet. The present application contemplates a helmet earpiece that attaches to these existing bolts located on helmets. In this respect, the helmet earpiece 100 may be retrofitted onto existing helmets. It is also contemplated that the earpiece 100 may attach to other helmet projections, as the invention is not necessarily so limited. For example, the earpiece may be configured to engage with a projection that is integrally formed to the helmet 100. The earpiece 100 may also be designed to engage with other projections on the helmet.

The above described helmet earpiece 100 and helmet 10 may have a variety of applications, including, but not limited to military applications and sporting applications. In a military application, a ballistic helmet and a ballistic earpiece may be provided. One of ordinary skill in the art would appreciate that a ballistic helmet is a combat helmet that is designed to protect the wearer's head from injury related to various projectiles.

The above described components may be made with various materials, as the invention is not necessarily so limited. In one embodiment, the helmet earpiece 100 may be made with one or more of the same types of materials that comprise the helmet 10. The helmet earpiece 100 and the helmet 10, may for example, be made of various plastic and/or metal layers. In one embodiment, the helmet earpiece 100 and/or helmet 10 may be made from an ultra-high molecular weight polyethylene known as Dyneema®, which may be obtained from DSM Dyneema LLC. In one embodiment, the helmet earpiece 100 and/or the helmet 10 may be made from a synthetic fiber known as Kevlar, which may be obtained from DuPont. In one embodiment, the helmet earpiece 100 and/or helmet may be made from carbon fibers. The helmet earpiece 100 and the helmet 10 may be made from materials designed to withstand various ballistic, compression and deformation testing, such that the earpiece 100 and helmet are suitable for various military applications.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A helmet comprising:

a detachable earpiece comprising an earpiece body having first and second features, the first feature comprising an opening in the earpiece body and a lock adjacent to the opening, the opening having first and second portions; and a helmet shell with complementary first and second features, the first and second features of the earpiece body engaging with the complementary first and second features of the helmet shell, the complementary first feature comprising a helmet projection;

wherein the lock comprises an unlocked position and a locked position;

wherein the opening in the earpiece body is a slot, the first portion of the opening having a first width to receive the complementary first feature when the lock is in the unlocked position, and the second portion of the opening having a second width to retain the complementary first feature when the lock is in the locked position, the first width being larger than the second width;

wherein, in the unlocked position, the complementary first feature is received in the first portion of the opening;

wherein, in the locked position, the complementary first feature is retained in the second portion of the opening, the lock is rotated from the unlocked position relative to the earpiece body, and at least a portion of the lock obstructs the opening and prevents the complementary first feature from moving into the first portion of the opening.

2. The helmet of claim 1, wherein the lock includes an outwardly extending gripping portion.

3. The helmet of claim 1, wherein the second feature is a flange spaced apart from the opening;

the complementary second feature is a channel;

and in the locked position, the channel receives the flange.

4. The helmet of claim 3, wherein the earpiece body has a first thickness and the flange has a second thickness, wherein the second thickness is less than the first thickness.

5. The helmet of claim 1, wherein the opening is substantially key-hole shaped.

6. The helmet of claim 1, wherein the earpiece body is curved to substantially follow a contour of a wearer's ear.

7. The helmet of claim 1, wherein the helmet projection comprises a bolt.

8. The helmet of claim 7, wherein the bolt is integrally formed with the helmet shell.

9. The helmet of claim 7, wherein the bolt includes a bolt head.

10. The helmet of claim 9, wherein a width of the bolt head is less than the first width but greater than the second width.

11. The helmet of claim 1, wherein the complementary second feature comprises a channel integrally formed with the helmet.

12. The helmet of claim 1, wherein the lock is rotated between the unlocked position and the locked position.

13. The helmet of claim 12, wherein the lock is rotated at least 90 degrees between the unlocked position and the locked position.

* * * * *